United States Patent [19]

Hergert

[11] 3,997,946

[45] Dec. 21, 1976

[54] METHOD FOR CONVEYING PATTERNED PILE FABRICS

[75] Inventor: Heinz Hergert, Frankfurt am Main, Germany

[73] Assignee: Polrotor Inc., N. Amityville, N.Y.

[22] Filed: Apr. 14, 1975

[21] Appl. No.: 567,932

Related U.S. Application Data

[60] Continuation of Ser. No. 426,828, Dec. 20, 1973, abandoned, which is a division of Ser. No. 147,585, May 27, 1971, Pat. No. 3,785,016.

[52] U.S. Cl. ..... 26/2 R

[51] Int. Cl.[2] ..... D06C 15/00; D06C 23/00

[58] Field of Search ..... 26/2 R, 2 E, 16, 27, 26/28, 30, 32, 69 A, 69 B, 69 C, 69 R; 38/64

[56] References Cited

UNITED STATES PATENTS

| | | | |
|---|---|---|---|
| 1,350,687 | 8/1920 | Turner | 26/30 UX |
| 1,553,830 | 9/1925 | Marble | 26/16 |
| 1,677,293 | 7/1938 | Prothers | 26/32 |
| 1,708,763 | 4/1929 | Huss et al. | 26/16 |
| 2,961,733 | 11/1960 | Hart | 26/2 E |
| 2,983,023 | 5/1961 | Hart | 26/2 E |
| 3,566,492 | 3/1971 | Handley et al. | 26/16 |
| 3,641,635 | 2/1972 | Martin | 26/2 E |

FOREIGN PATENTS OR APPLICATIONS

| | | | |
|---|---|---|---|
| 1,129,180 | 9/1956 | France | 26/2 E |
| 494,149 | 5/1954 | Italy | 26/69 B |
| 5,392 | 1896 | United Kingdom | 26/69 R |
| 8,390 | 1903 | United Kingdom | 26/28 |

*Primary Examiner*—Robert R. Mackey
*Attorney, Agent, or Firm*—Eisenman, Allsopp & Strack

[57] ABSTRACT

A method of conveying pile fabrics, wherein portions of the fabric are selectively presented to the processing equipment in order to process the various portions differently. In carrying out the processing, the fabric is conveyed along a path adjacent to the processing units, which path is defined by separately controlling the distance of the fabric from two separate axes that are parallel to each other and transverse to the direction of fabric conveyance.

10 Claims, 19 Drawing Figures

METHOD FOR CONVEYING PATTERNED PILE FABRICS

CROSS-REFERENCE TO RELATED APPLICATION

This application is a continuation of application Ser. No. 426,828 filed Dec. 20, 1973, now abandoned, which is a division of application Ser. No. 147,585 filed May 27, 1971, now U.S. Pat. No. 3,785,016 granted Jan. 15, 1974.

BACKGROUND OF THE INVENTION

1. Field of the Invention

This invention is concerned with the processing of pile fabrics. More particularly, it relates to a method of presenting pile fabrics to processing tools.

2. Description of the Prior Art

Within the context of the present invention, the general classification, "pile fabrics", covers a variety of materials. These materials range from fine velours to heavy carpeting, and include such diverse products as napped liners, suedes, flocked prints, velvets, and double sided blankets. The basic cloth from which such pile fabrics are produced may be knitted, tufted, or woven.

Pile fabric processing, irrespective of the particular material involved, is primarily concerned with developing a final product having desired characteristics and appearance. Usually, when this objective is achieved, the individual fibers of the product are untangled, the lay of the fibers is consistent, the length of the pile is uniform, and the finish is substantially permanent. The appearance of a product is also affected by the use of selective coloring, different fabrics, and different types of knitting or tufting, either alone or in combination.

In its principal use, the present invention is concerned with the fabric processing techniques which physically alter the characteristics of the material by selective treatment thereof with electrification, ironing, brushing, or the like.

Although the introduction of synthetic fibers, of the type frequently used today, is relatively new to the industry, equipment for sculpturing and surface treating plush fabrics has long been known in the art. In the 19th Century sculptured shearing with a shear revolver having movable shearing elements was disclosed by U.S. Pat. No. 265,644, dated Oct. 10, 1882; and the "marbelizing" of plush fabrics using a padded roller to press the plush surface upon a heated drum is shown in U.S. Pat. No. 362,178, dated May 3, 1887. Further developments have suggested the utilization of patterned rolls and/or conveyance systems which either press or withhold fabrics from processing surfaces or tools.

A survey of the art, however, shows that as a general rule, the techniques employed to date suffer from several distinct disadvantages; they usually require expensive and sometimes complicated equipment; they are restricted to the production of a particular design which cannot be changed without the manufacture of additional specially prepared pattern drums; they generally tend to deform or disarrange the pile surface in a manner which lacks uniformity and esthetic appeal; and they do not take adequate account of the characteristics of modern materials.

SUMMARY OF THE INVENTION

The present invention provides an improved method of conveying fabrics for the development of sculptured effects on pile fabrics. These sculptured effects may be produced by a variety of processing tools and the particular pattern of sculpturing is designed at will by the processor or equipment operator.

As noted above, there has been recognition of ironing, shearing, electrification, brushing and other techniques for producing sculptured effects. Each of these operations has previously required a separate machine. The present invention eliminates the need for such separate machinery by providing a universal conveying method which may incorporate uniquely designed pattern rolls; this conveying method being operative in conjunction with a plurality of processing tools. Thus, embodiments of the invention illustrate cooperation with electrifier cylinders to produce sculptured effects upon pile fabrics wherein the pile is of substantially equal length throughout but wherein the lustre of selected areas of the fabric differs in accordance with a prescribed desired pattern. Embodiments of the invention are also illustrated in conjunction with ironer rolls and thermo-sculpturing apparatus to achieve sculptured effects by either variations in surface reflectivity and lustre or by actual variations in surface height of the pile.

An object of the invention is to provide an improved method for the processing of synthetic pile fabrics, wherein the conveying equipment yields superior processing versatility.

Another object of the invention is to provide an improved method for conveying fabrics past processing tools, and wherein surface patterns may be established on pile fabrics at the will of the operator.

In accordance with the present invention there is provided a method for the treatment of synthetic pile fabrics wherein a treatment zone is established within which the fabric may be heated, cooled, ironed, beaten, and electrified, either individually or in combination. The fabric is then transported into this zone in a selective manner so that some areas of the fabric are exposed to treatment more than others. The result is a sculpturing effect which is permanently impressed into the pile.

A complete appreciation of the objects of the invention, along with an understanding of the various aspects and features thereof, will be available from the following description which is made in conjunction with the drawings.

DETAILED DESCRIPTION OF THE PREFERRED EMBODIMENTS

Figure 1:
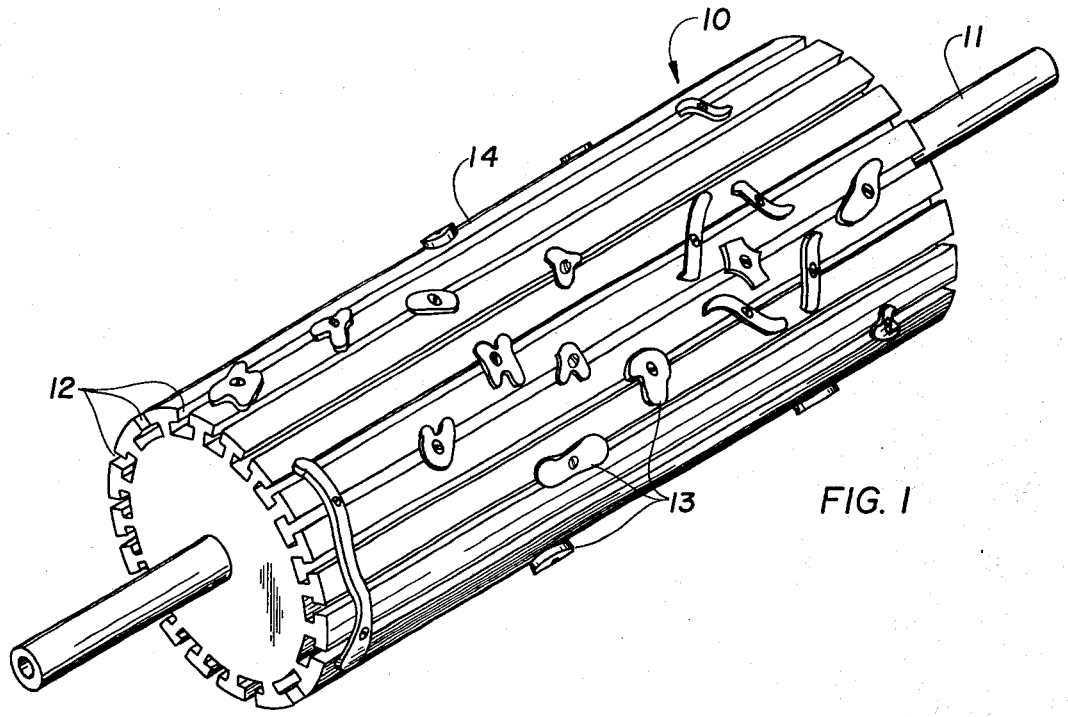
FIG. 1 is a perspective view of a pattern roll with pattern profiles mounted thereon, which may be used in carrying out embodiments of the invention.

The pattern roll shown in FIG. 1, is mounted upon an axle 11 for rotational motion. Not shown in this figure are the necessary drive means by which the roll is driven either in synchronism or out of synchronism with the basic fabric conveyance system. The particular drive means is provided with speed and capacity in accordance with the specific desires of the equipment designer. Each pattern roll has a plurality of surface indentations 12 upon its surface 14. In FIG. 1, these surface indentations take the form of longitudinal slots extending parallel to the axis of the cylinder. In other applications, it may be desired to have the indentations with other orientations and configurations. These indentations are provided with a widened area on their radially interior portions as means for conveniently fastening pattern profiles 13. The pattern profiles 13 are contoured in any of an infinite number of designs in accordance with the ultimate pattern effect desired by the equipment user. Each pattern profile is individually mounted in the cooperating slots of the pattern roll and consequently their radial and axial positioning may be determined at will. The pattern profiles are preferably fabricated of a heat conductive material. The pattern roll is preferably provided with heating elements 17 therein. Thus, the pattern profile conducts the heat from the surface of the cylinder into direct contact with any fabric conveyed thereacross. The use of a heated pattern roll is of particular value with respect to modern fibers because such fibers are characteristically thermosetting in nature and will be set into desired configurations under the influence of heat.

By utilizing such a roll, one is enabled to design the pattern applied to a particular pile fabric with an infinite number of possibilities, the design being limited only by the imagination of the user. The various pattern profile blocks may be provided in several standard forms so that the user can develop his own arrangement, or they may be specifically formed for particular patterns.

Figure 2:
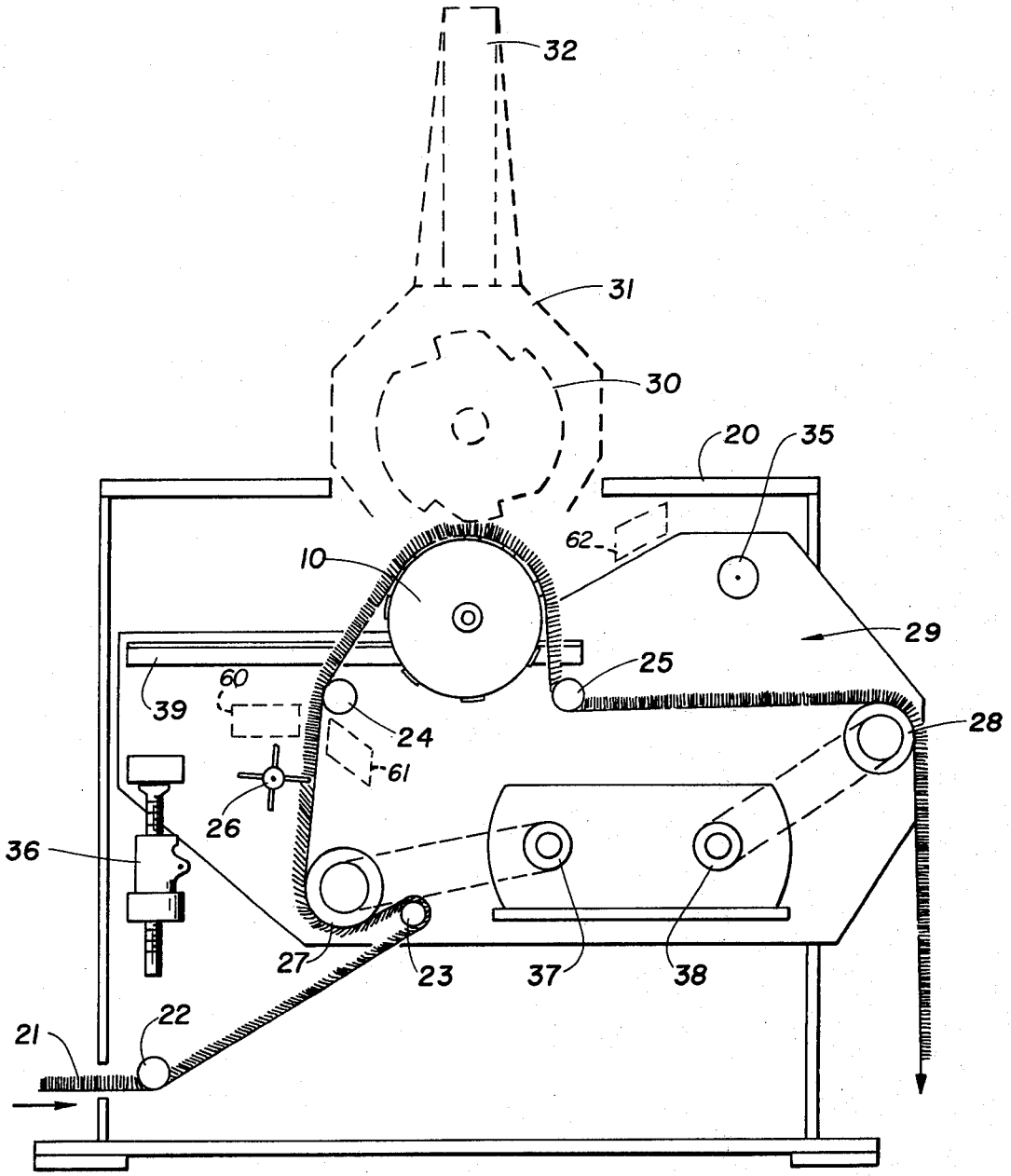
FIG. 2 is a schematic view of apparatus and illustrating the conveyance path of fabric through such an apparatus.

Attention is now directed to FIG. 2 wherein a conveyor system employing a pattern roll is schematically illustrated. A main frame conveyor console 20 contains a pattern roll 10 and basic conveying elements for the transport of a pile fabric 21, in the direction of the arrows. The conveyor console 20 includes a number of conventional conveying elements; this particular illustration including a plurality of idler or reversing rolls 22–25; a pile beater 26; a feeder roll 27; and a delivery roll 28. The pattern roll 10 is positioned near the top of the equipment in close proximity to an electrifier cylinder 30. Electrifier cylinder 30 is disposed within an exhaust hood 31 that is in turn connected to an exhaust duct 32. Each of the latter elements are illustrated in dashed outline form because the details thereof are not germane to the invention.

The conveyance console is specifically designed for cooperation with any one of a plurality of processing units similar to the illustrated electrifier cylinder. The conveyance console is positioned on the floor of a plant and various processing elements are selectively and alternatively brought into cooperation therewith. This makes possible the provision of a single universal conveyance system having the capabilities for sculpturing presented in this invention, along with individual processing elements only. Each processing unit may be heated or non-heated, and may be provided with differential speed control. As illustrated in FIGS. 8A–8G, in addition to electrifier cylinders of the type suggested in FIG. 2, it is contemplated that ironer plates, rotary ironers, fractional ironers, brushes rotating about either parallel or orthogonal axes, and thermo-sculpturing tools, may be used. These applications are explained in more detail hereinafter.

The major conveying elements on the console 20 are mounted upon a conveyor carriage 29 which is adjustable for pivoting about a pivot axis 35. Positioning is under the control of a right angle worm lifter screw 36 which appears in the left central portion of the figure. Thus, reversing roller 23, feeder roll 27, beater 26, idler roll 24, pattern roll 10, idler roll 25, and delivery roll 28, are all mounted upon the pivotable adjustable conveyor carriage 29. This facilitates variable speed adjustable tension control for various positions of pattern roll 10. The conveyance system is driven by means of output shafts 37 and 38 which in turn are controlled in any desired way, preferably with variable speed drives. These drives may or may not be connected to the pattern roll drive. The mounting of pattern roll 10 on a movable carriage renders it suitable for cooperation with the various processing heads to be used.

In the event it is determined that the processing unit or equipment will function best with preheating of the fabrics before presentation, or cooling of the fabrics upon exit therefrom, means may be provided on the conveyance console for such preheating and cooling. For example, heating elements 60, 61 may be provided on the entrance side of the console and cooling unit 62 may be provided on the exit side of the console. The specific means used are not germane to the invention and may be selected in the discretion of the designer, depending upon the materials being processed and the processing units being serviced.

As illustrated in FIG. 2, the adjustable conveyor carriage also includes a rail or channel means 39 by means of which the pattern roll 10 may be slid away from any processing unit for convenient positioning of the pattern profiles.

Figure 3:
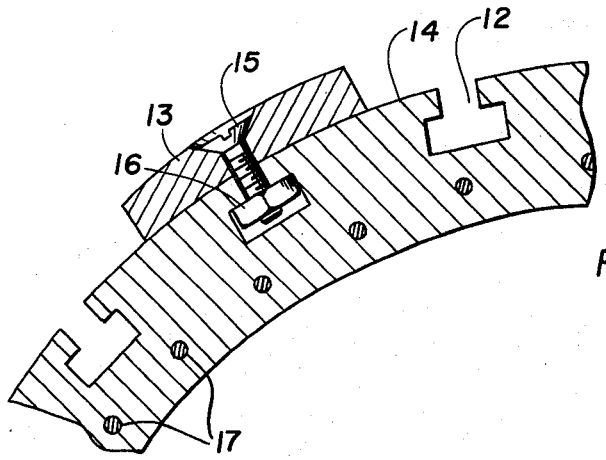
FIG. 3 is an enlarged cross-sectional view illustrating the mounting of a pattern profile upon the circumference of a pattern roll.

With a general understanding of the manner in which the conveying system is arranged, attention is now redirected to the profile pattern roll itself. FIG. 3 shows an enlarged partial cross-sectional view taken along a radial plane through a pattern roll upon which a pattern profile block 13 is mounted. As shown in this figure, a convenient mounting arrangement involves the utilization of a threaded bolt 15 and locking nut 16. The locking nut is dimensioned for non-rotatable positioning within the lower channel of slots 12. Thus, the bolt 15 can be easily entered and secured. Each profile block contains at least one countersunk hole therethrough for placement of the threaded bolt 15. In addition, each profile block has a concave surface contoured to comply with the surface of the pattern roll. This makes it possible to securely mount the pattern block 13 in either of two 180° opposed directions. It is not possible with this specific design to rotate the pattern block 90° and thus have it directed longitudinally along the pattern roll. In such a 90° reoriented position, the concavity on the inner face of the block would be inappropriate to the straight linear longitudinal surface of the pattern roll.

Figure 4A:
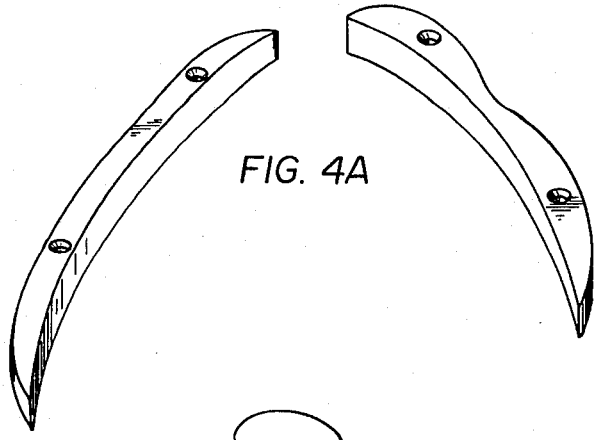
FIGS. 4A–4E are schematics of typical pattern profiles which may be employed in conjunction with a pattern roll.
Figure 4B:
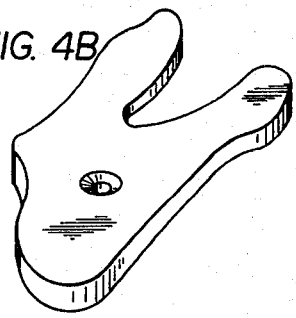
Figure 4C:
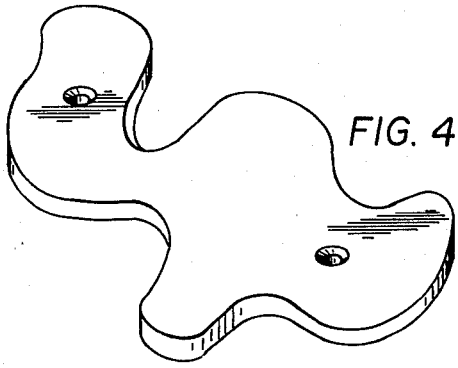
Figure 4E:
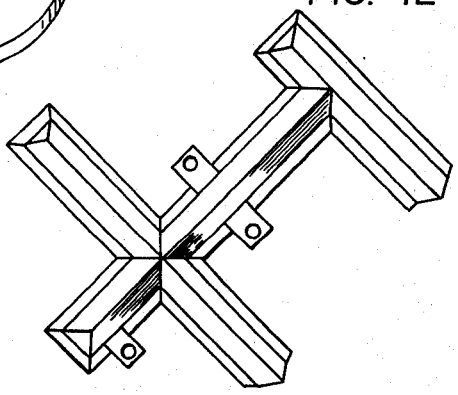
Figure 4D:
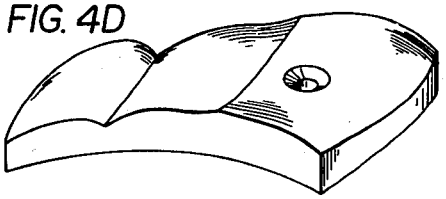

FIGS. 4A–4E illustrate typical profiles that may be utilized in conjunction with the pattern roll of the invention. FIG. 4A shows a pair of pattern profiles for imposing line patterns into the pile fabric being processed. Each profile has a concave lower face adapted to conform to the surface of the pattern roll and includes two countersunk holes for retaining bolts. FIGS. 4B and 4C illustrate the versatility available with the pattern blocks of the invention and respectively show pattern profiles for a right and left helix. FIG. 4D illustrates a multi-level profile, having only a single aperture for the necessary securing bolt. Here, too, the number of levels appearing upon the profile is not restricted by the invention. FIG. 4E illustrates a geometric profile wherein three clamp fasteners are employed. Obviously any geometric pattern may be developed and the specific means for securing the pattern to the pattern roll may vary within the teachings of this invention. There is no specific limitation upon the number of securing bolts utilized for the surface area that a particular pattern may encompass. The specific surface areas are within the control of the designer, and it may be deemed advantageous to have a limited number of conventional forms which can be positioned by either interlocking or opposing positions upon the surface of the cylinder. In addition, where small areas are involved, the inner surface of the pattern profile need not be concave.

Figure 5:
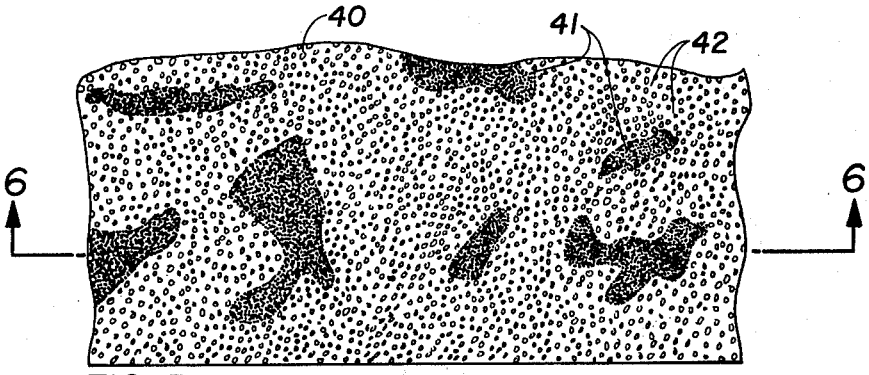
FIG. 5 is a top view of a pile fabric after having been treated in accordance with the features of the invention.
Figure 6:
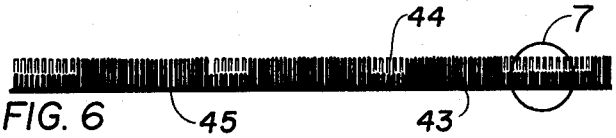
FIG. 6 is a cross-sectional view taken along the lines 6—6 of FIG. 5.
Figure 7A:
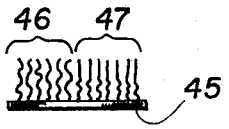
FIGS. 7A and 7B are enlarged views of the area 7 encircled in FIG. 6 showing the effects of selective electrifier contact.
Figure 7B:
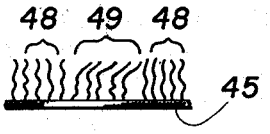

FIGS. 5 – 7 schematically illustrate the result of passing a synthetic pile fabric past an electrifier cylinder while utilizing a conveying system employing the method and apparatus of this invention. FIG. 5 is a top view of such a fabric and clearly illustrates the difference in lustre or surface appearance resulting from the various profile patterns on the pattern roll. The areas 41 are those in which the pattern profiles were present, in contrast with the areas 42 wherein the profile patterns were absent. The cross-section shown in FIG. 6 illustrates that the presence of a pattern profile, for example, in area 43, caused the fabric to be subjected more thoroughly to processing with the result of distinctive pile condition. The absence of a pattern profile, for example, in the area 44, resulted in a different pile conditioning. The circled portion 7, shown in FIG. 6, is enlarged in FIGS. 7A and 7B to illustrate more graphically the results of this type of pile processing.

In FIGS. 7A and 7B, the backing 45 is shown to secure a plurality of fibers 46–49. As a result of processing utilizing the pattern roll, the fibers 47 that were in proximity to the profiles all stand substantially uncurled and virtually perpendicular relative to the backing. On the other hand, the fibers 46 on the left side of FIG. 7A have more curl and deformed root portions. In FIG. 7B, the pattern profiles additionally tended to effect an ironing down of fibers 49, while fibers 48 were rendered erect. It will be appreciated that the areas proximate to the pattern profiles provide a different lustre or appearance. In other words, a sculptured effect is produced, without shearing. Still further, the effect is permanent.

It has been mentioned above that a variety of processing units may be employed with this universal conveying system. Typical units have been shown by way of example in FIGS. 8A–8G. The versatility provided by this invention makes possible the utilization not only of varying units, but also varying speeds of conveyance and operation vis-a-vis the processing units used. It is also possible to selectively employ heating, either in the pattern roll or in the processing unit itself.

Figure 8A:
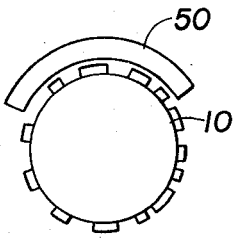
FIGS. 8A–8G are schematics showing various processing arrangements using the features of the invention.

In FIG. 8A there is illustrated a pattern roll 10 operating in conjunction with a concave ironer plate 50. The ironer plate in such a configuration may be provided with a concave curvature substantially concentric with the curvature of the pattern roll and of arc length commensurate with the desired ironing effects. In a typical installation, the ironer plate would be heated and would be mounted for the application of adjustable pressure relative to the pattern roll. Under such circumstances, the pattern roll itself may be run either in synchronism with the conveying system or at a different speed in order to produce slurred patterns. The pattern roll may be either heated or operated at ambient temperatures.

Figure 8B:
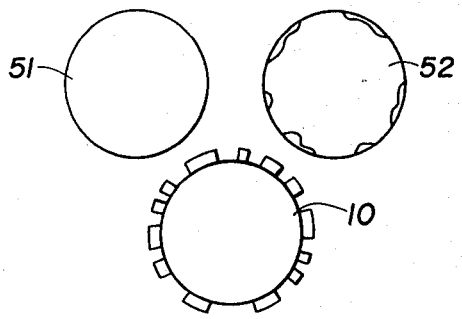

FIG. 8B illustrates a configuration wherein rotary ironing is carried out. In this case the pattern roll 10 operates in cooperation with two pressure heated cylinders 51 and 52 which are mounted upon parallel axes. The pressure cylinders may be either operative at heated or ambient temperatures and they may be controlled with a variable speed control vis-a-vis the pattern roll. It is contemplated that the pressure cylinders may operate with reversible rotation if desired and that they may include surface designs. Once again, the pattern roll exhibits its customary versatility relative to the particular profiles utilized thereon; may employ a variable speed drive; and may be operated at either heated or ambient temperatures. As a result of the adjustable carriage configuration discussed in connection with FIG. 2, the pattern roll also is able to apply adjustable pressure in accordance with the desires of the operator.

Figure 8C:
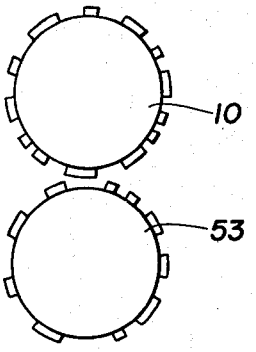

Still another type of ironing operation may be carried out with a fractional ironer as shown in FIG. 8C. In this case, the pressure roll may have a contoured face if desired and it may include sculptured or plain profiles. Both the pattern roll and the pressure roll may be heated or operated at ambient temperature and with variable speeds. Optional reversible rotation may be provided.

Figure 8D:
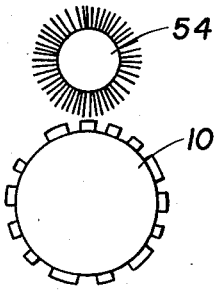

In the event that it is desired to brush portions of a pile fabric on a selective basis, for example, in order to untangle the surface of certain portions of pile while leaving the rest intact, one may utilize the combination of components shown in FIG. 8D wherein the pattern roll is parallel with a rotary brush 54. Once again, it is noted that the brush may be driven at variable speeds, with adjustable pressure and in reversible directions. The pattern roll may also be controlled under variable speeds at either heated or ambient temperatures. It will be appreciated that the brushing of thermo-setting materials is generally an intermediate step and produces a relatively transient finish, nevertheless, this may be a desirable operation as an intermediate step in conjunction with a complete pile processing operation. On the other hand, the brushed condition can be set into the fabric with proper heating of the pattern roll.

Figure 8E:
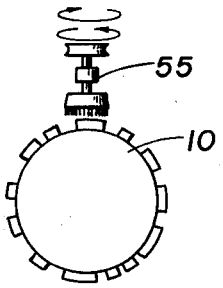

FIG. 8E illustrates yet another processing operation that may be performed in conjunction with the pattern roll 10. In this case, one employs swirling brushes 55 rotating about an axis perpendicular to the axis of the pattern roll. The amount of contact with these brushes is determined by the configuration on the pattern roll and if it is desired, one may even select pattern profiles which, in effect, provide a completely smooth surface upon the pattern roll.

Figure 8F:
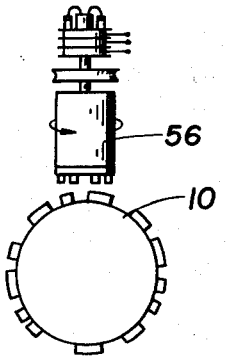

FIG. 8F illustrates the utilization of a pattern roll 10 in conjunction with electrifier units 56 which are axially disposed along the longitudinal axis of the pattern roll. The adjacent edge of units 56 interacts with the pile on the pattern roll. This type of vertical electrification provides an effect somewhat like that of the brush swirling. On the other hand, greater permanence is achieved because of the possibility of heating both the swirling electrifier and the pattern roll. Further yet, the ability to vary patterns and thereby bring the material into greater or less contact with the vertical electrifier yields considerable advantage for the fabric designer.

The method practiced in this invention is concerned primarily with the establishment of a "treatment zone" wherein pile fabric is processed. As explained above, the processing may include a variety of treatments and would generally be carried out with such conventional elements as brushes, ironers, electrifiers and the like. Such elements have a definite range of influence and the method is concerned with selectively bringing the pile into this range so that different areas are differently processed.

The invention is particularly concerned with modern synthetic pile fabrics, because these fabrics have characteristics of plasticity and respond to electro-static influences in a special way. By using the method and apparatus of the invention, one may take advantage of these characteristics to first render the pile more pliable (e.g., by heating), then subjecting it to heating and electrical polarization (e.g., with an electrifier), and thereafter permanently set it (e.g., by cooling).

Figure 8G:
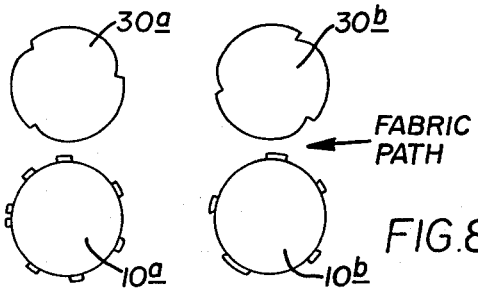

When processing with equipment such as electrifiers, a sculpturing effect is achieved by selective variations in surface lustre and this can be accomplished by changing the pile lay and/or deforming the pile. The method and apparatus of this invention is particularly useful in obtaining such effects. As shown by the illustrations previously discussed, the use of a pattern roll permits selective pile deformation. It is further found that by using the concept of plural treatment zones arranged one after the other, both pile deformation and selective pile lay can be obtained. For instance, FIG. 8G illustrates two electrifiers 30*a* and 30*b* used with a single conveyance system. The direction of rotation of the electrifier cylinders can be either similar or reversed, and the speed of the pattern roll or rolls can be determined as desired.

In recapitulation, it will be seen that by utilizing the present invention, it is possible to achieve results in the treatment of fabrics that have heretofore been unavailable. These results include a wide versatility of designs at the will and convenience of the particular fabric processor. The results of utilizing heated equipment in conjunction with synthetic fibers which are of a thermo-setting nature, also insures permanence of finish. Still further, the method of this invention is operable in conjunction with a multiplicity of highly specialized processing elements and thereby avoids the need for a large number of specialized machines, each having its own conveying system.

It is appreciated that those skilled in the art will immediately recognize modifications that may be made in the specific illustrative embodiments described hereinabove. For example, it is within the contemplation of the invention to automate the various features and functions described. All such modifications as come within the spirit and teachings of this invention, are intended to be covered by the following claims.

What is claimed is:

1. The method of conveying pile fabrics over a predetermined path between feeder and delivery rolls for processing by pile modifying equipment having a degree of effectiveness determined by the distance of the fabric therefrom, comprising: driving said feeder and delivery rolls to convey said fabric under controlled tension past said equipment; continuously supporting said fabric with a rigid surface of irregular contour on the side remote from said equipment to establish the proximity of selected portions of the fabric to the equipment within a predetermined range; and adjustably positioning said rigid surface, said feeder roll simultaneously about a common axis, and said delivery roll, without affecting said controlled tension, to establish the proximity of said range to said equipment.

2. The method of conveying pile fabrics in accordance with claim 1, wherein said equipment effects heating.

3. The method of conveying pile fabrics in accordance with claim 2, wherein said equipment further effects the establishment of an electrostatic charge on the fibers of said fabrics.

4. The method of conveying pile fabrics in accordance with claim 3, wherein said equipment further effects beating the fibers of said fabrics.

5. The method of conveying pile fabrics in accordance with claim 1, including preheating said fabrics before presentation to said equipment and cooling said fabrics upon exit therefrom.

6. The method of conveying pile fabrics in accordance with claim 1, including heating the non-pile surfaces of said fabrics while being processed by said equipment.

7. The method of conveying pile fabrics in accordance with claim 1, wherein said predetermined range is established as the difference between minimum and maximum radii from an axis transverse to the direction of conveyance.

8. The method of conveying pile fabrics in accordance with claim 7, wherein said positioning is established by rotating said axis about a second axis parallel thereto.

9. The method of conveying pile fabrics in accordance with claim 1, including positively driving said feeder and delivery rolls.

10. The method of conveying pile fabrics in accordance with claim 9, wherein said feeder and delivery rolls are driven independently.

* * * * *

UNITED STATES PATENT OFFICE

CERTIFICATE OF CORRECTION

Patent No. 3,997,946 Dated December 21, 1976

Inventor(s) Heinz Hergert

It is certified that error appears in the above-identified patent and that said Letters Patent are hereby corrected as shown below:

| | | |
|---|---|---|
| Column 8, | line 24 | Delete "si-" and substitute therefore -- , -- |
| | line 25 | Delete "multaneously about a common axis," |
| | line 26 | After "roll" and before the comma, insert --simultaneously about a common axis--. |

Signed and Sealed this

Fifteenth Day of March 1977

[SEAL]

*Attest:*

RUTH C. MASON
*Attesting Officer*

C. MARSHALL DANN
*Commissioner of Patents and Trademarks*